United States Patent [19]

Bergqvist et al.

[11] Patent Number: 4,784,517

[45] Date of Patent: Nov. 15, 1988

[54] METHOD AND DEVICE FOR WORKING OF ROAD SURFACES

[75] Inventors: Sven A. Bergqvist; Jan-Gunnar Hedlund, both of Sandviken; Bert G. Levefelt, Mariestad, all of Sweden

[73] Assignee: Sandvik Aktiebolag, Sandviken, Sweden

[21] Appl. No.: 775,687

[22] Filed: Sep. 13, 1985

[30] Foreign Application Priority Data

Sep. 18, 1984 [SE] Sweden ..... 8404673

[51] Int. Cl.[4] ..... E01C 23/12

[52] U.S. Cl. ..... 404/75; 404/90; 299/36; 299/86; 299/40; 37/141 R; 172/701.1; 172/766

[58] Field of Search ..... 404/75, 90, 91; 299/36, 299/39, 86, 40, 41; 37/141 R, 141 T, 142 R, 142 A; 172/701.1, 701.3, 747, 766

[56] References Cited

U.S. PATENT DOCUMENTS

| | | | |
|---|---|---|---|
| 1,872,601 | 8/1932 | McHale | 299/36 X |
| 2,804,294 | 8/1957 | Meagher | 299/40 |
| 3,041,055 | 6/1962 | Risse | 299/86 |
| 3,361,481 | 1/1968 | Maddock | 299/86 |
| 3,499,685 | 3/1970 | Kniff | 299/86 |
| 3,754,791 | 8/1973 | Hoermann | 299/36 |
| 4,561,698 | 12/1985 | Beebe | 299/86 |

FOREIGN PATENT DOCUMENTS

| | | | |
|---|---|---|---|
| 2644992 | 4/1978 | Fed. Rep. of Germany | 404/90 |
| 2837784 | 3/1980 | Fed. Rep. of Germany | 299/86 |
| 2029761 | 3/1980 | United Kingdom | 299/86 |
| 84/00987 | 3/1984 | World Int. Prop. O. | 404/90 |

OTHER PUBLICATIONS

Kennametal, Inc. Mechanical Drawing Nos. 984-8495A and 984-8427A, Oct. 1969.

*Primary Examiner*—Stephen J. Novosad
*Assistant Examiner*—John F. Letchford
*Attorney, Agent, or Firm*—Burns, Doane, Swecker & Mathis

[57] ABSTRACT

A cutter (10) intended for use on a planing blade on a road planing machine is provided with a plurality of tools (14) rotatably mounted in the cutter. The tools (14) are mounted side by side and are adapted to carry out the working of the road surface (17).

16 Claims, 2 Drawing Sheets

METHOD AND DEVICE FOR WORKING OF ROAD SURFACES

The present invention relates to a method and a device for working a road surfaces, such as planing of roads having gravel or oil-gravel surfaces and ice-scraping, wherein a plurality of wear elements carried by a machine for working of road surfaces are adapted to remove material from the road surface. Particularly, the invention relates to a cutter for a planing blade which is intended to be attached to a machine for working of road surfaces, such as planing of roads having gravel or oil-gravel surfaces and ice-scraping.

In conventional planing blades the removal of material is carried out by a cutting operation which means that high abrasive wear of the wear element is obtained. During planing of the road surface by means of fixedly mounted wear elements the relative velocity at the contact point between the wear elements and the road surface is always as high as the nominal velocity by which the machine moves along the road. This type of working requires supply of very high energy and causes high costs at breakdowns due to the fact that the whole cutting edge has to be changed when damages thereon do arise.

In such conventional planing blades the wear thereof basically arises in form of abrasive wear. Wear is defined as a successive transport of material from the surface layer of a body during mechanical contact. During mechanical surface contact between solid bodies a variety of physical and chemical phenomena does arise, said phenomena being affected by friction, lubrication and wear of abrasion. The abrasion phenomena are seldom present in one shape; different phenomena do interact under the influence of outer and inner parameters.

The abrasive wear arising at conventional planing blades means that a hard component makes scratches in a surface having less hardness.

The resistance to abrasive wear is proportional to the hardness. Therefore, as the knowledge of this fact increases the material in cutters for planing blades has been chosen in direction toward higher and higher bulk and surface hardness. The increase in hardness, however, does always occur to the detriment of decreased toughness.

For a long time wear elements of simple carbon steel were used. Today, however, normally tough-hardened steels are used, which have considerably better wear resistance than the simple carbon steels.

During the last decades different proposals for better road maintenance tools have been presented, often as hard metal wear elements in form of steel cutters either having cast-in-carbide or having hard metal wear elements brazed thereto. All presented systems, however, have the disadvantage that they are susceptible to temperature and mechanical shocks, and have therefore been used only to a very little extent. When stationary wear elements are used on a cutter or mounting plate which is stationary relative to the machine, the real velocity at the contact point between the wear elements and removed road surface is equal to the nominal velocity of the machine.

A further disadvantage of the above prior art wear elements is that they have such large dimensions that the overall contact pressure against the road surface requires very high nominal normal forces in order to ensure that the tool will penetrate into and cut through the substratum.

For cutting or milling of asphalt it has been proposed to use wear elements in form of hard-metal-equipped tools, which are rotatably mounted in their holders. In this case, the tools are mounted on a cutter drum which, in use, rotates and creates a relative velocity at the point of attack between the hard metal tip and the road surface which velocity is considerably higher than the velocity of the machine along the road. Such a cutting operation carried out by milling is an expensive and difficult-to-control method which is practically and economically unacceptable to use for instance for ice-scraping of a winter road surface. In tests which have been made the costs for repairing a damaged road surface have sometimes been considerably higher than the estimated profit.

In similarity with the above-described planing operation the milling operation is characterized by that a high energy requiring cutting operation is carried out which results in large abrasive wear of the tools.

The object of the present invention is to provide an apparatus for road maintenance which has very high wear resistance and functional stability in combination with high material removing capacity while simultaneously requiring supply of small amount of energy.

The above and other objects are attained by giving the invention the characterizing features stated in the appending claims.

The invention is described in detail in the following description with reference to the accompanying drawings in which one embodiment is shown by way of example. It is to be understood that this embodiment is only illustrative of the invention and that various modifications thereof may be made within the scope of the claims.

Figure 2:
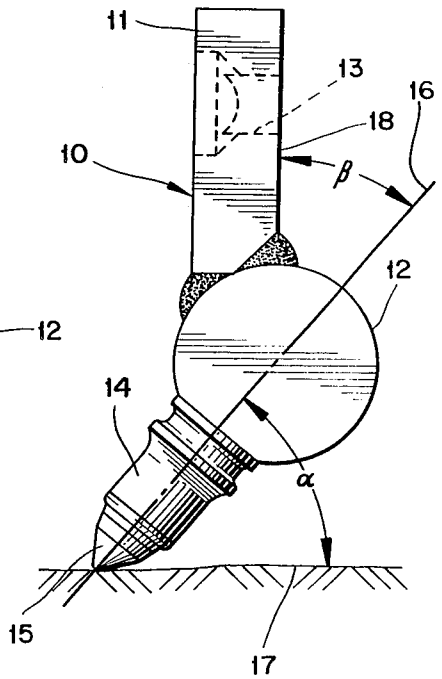
FIG. 2 shows a side view of the cutter.
Figure 1:
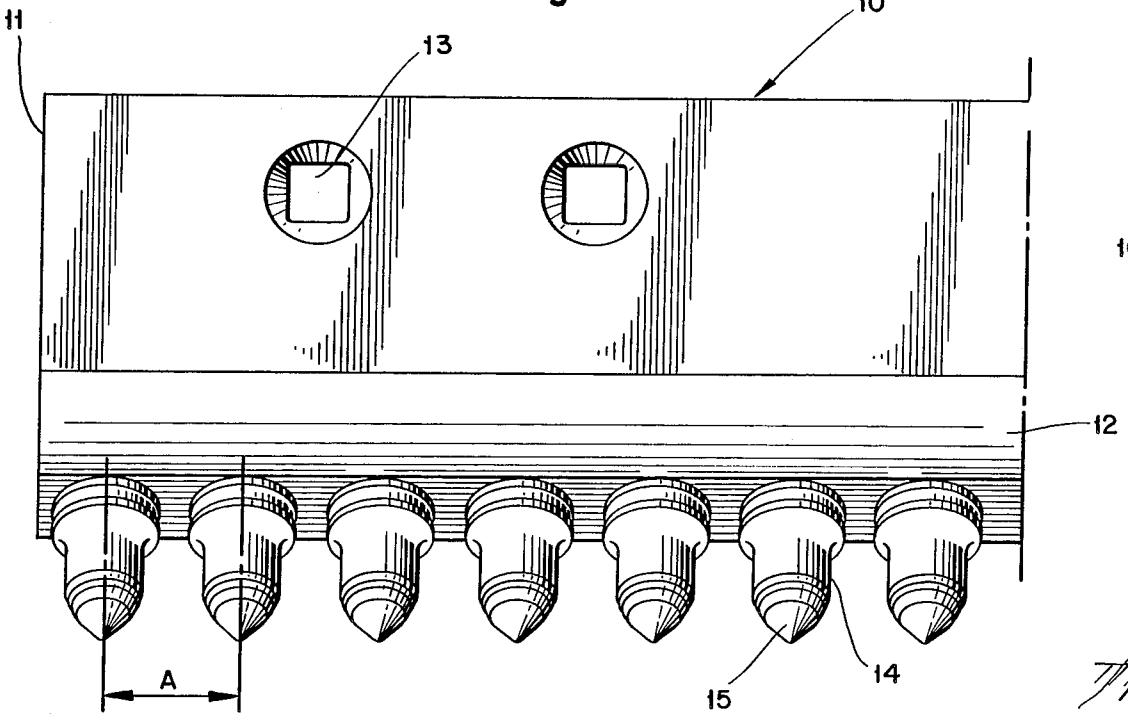
FIG. 1 shows a front view of a cutter according to the invention.
Figure 3:
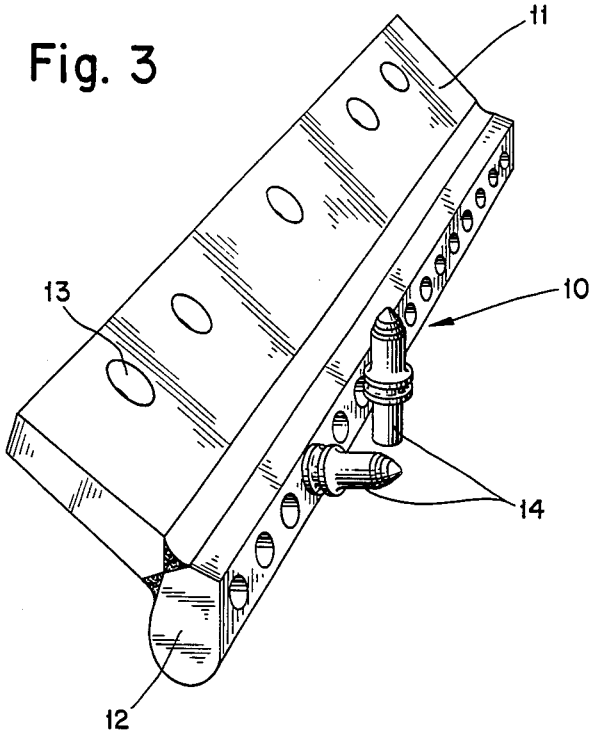
FIG. 3 shows a perspective view of the cutter in FIGS. 1 and 2 having one tool mounted therein and having one loose tool in front of the cutter.

The cutter generally denoted by 10, comprises a base member 11 and a holder body 12 welded thereto. The base member 11 is provided with holes 13 traversing therethrough and intended to receive bolts by means of which the holder body 12 is attached to a planing blade, not shown, on a machine for working of road surfaces, such as planing of roads having gravel or oil-gravel surfaces and ice-scraping.

According to the invention a plurality of tools 14 are rotatably mounted in the holder body 12. The tools, which are provided with a cutting tip 15 of hard metal, are of the general type disclosed in U.S. Pat. No. 4,201,421. Therefore, this patent is incorporated in the present specification by way of reference. Thus, the tools 14 are received in the holes in the holder body 12 and are axially secured in the holes by means of a sleeve mounted on the tool shank, said sleeve allowing rotation of the tool 14 about the longitudinal axis 16 thereof. Consequently, the real cutting edge of the cutter 10 consists of the hard metal tips 15.

In the illustrated embodiment the longitudinal axis 16 of the tool 14 forms an angle $\alpha$ with the road surface 17 when the base member 11 is mounted on the planing blade, which angle can have values between 20° and 90°, with preference for values in the order of 50°. Further, the longitudinal axis 16 of the tool forms an angle $\beta$ with an abutting surface 18 on the base member 11 intended to rest against the planing blade, said angle suitably having values between 20° and 50°.

The distance A between adjacent tools 14 can have values between 30 mm and 50 mm, which preference for values in the order of 38 mm.

Preferably, the cutter 10 comprises a plurality of sections arranged after each other so that a desired overall length of the cutter is obtained.

It is believed that removal of material in the road surface according to the invention is carried out under rolling contact between the tool tips 15 and the road surface. Due to the fact that the coefficient of friction is high and due to the fact that there are differences in the modulus of elasticity of the materials at the contact points a wall is formed in front of the "roller" 15 when the latter is forced against and rolls over a more or less planar surface. The "roller" 15 pushes the wall in front of itself and, upon application of a pressure high enough, the wall and the material attached thereto are rolled or torn away from the substratum. The removal of material, thus, is caused by roll forming and not by a cutting operation resulting in abrasive wear, i.e. material is to a substantial extent removed from the road surface by crushing the material during rolling thereof.

The wear elements or tools 14, thus, are carried by the supporting device 10 which is mounted on the machine stationary relative thereto. Due to the rolling of the tips 15 against the road surface the wear elements 14 will rotate about their longitudinal axes 16, with the result that the velocity of the wear elements 14 at their contact points with the road surface is lower than the velocity of the machine and the supporting device 10.

When material is removed basically by crushing under rolling of the substratum according to the present invention the wear of the tools is considerably lower than if the material is removed by means of a cutting operation. Further, considerably less energy is consumed when compared to the conventional merely abrasive material removal at a cutting operation. As above-mentioned the real velocity at the contact point between the wear elements 14 and the material to be worked is always lower than the universally usable. Thus, it is usable for planing of all types of roads as well as for scraping of ice during wintertime.

We claim:

1. A method for working of road surfaces, such as planing of roads having gravel or oil-gravel surfaces and ice-scraping, comprising rotatably mounting a plurality of wear elements in a support device having a base member and a holder body, moving the plurality of wear elements along the road surface with said wear elements being arranged in a row in said holder body and said base member connected to means for working the road surfaces which permits substantially only linear movement of said support device, including causing the wear elements to rotate about their longitudinal axis due to abutment against the road surface.

2. A method according to claim 1, further including moving the row of wear elements along the road surface under an angle of between 30° and 40° with the road surface.

3. A device for working of road surfaces, such as planing of road having gravel or oil-gravel surfaces and ice-scraping, comprising a mounting plate for attachment to a machine for working of the road surface, and a plurality of wear elements having tips arranged in a row on said mounting plate, wherein the wear elements are rotatably mounted on the mounting plate to remove material from the road surface to a substantial extent by crushing the material under rolling contact between the tips and the road surface.

4. A device according to claim 3, wherein a frontal portion of the wear elements intended to rest against the road surface is substantially conical and adopted to rest against the road surface along an envelope surface of the frontal portion, and each wear element forms an angle between 30° and 40° with the road surface.

5. A device for working of road surfaces, such as gravel or oil-gravel surfaces and ice scraping, comprising a plurality of wear elements adapted to displace material from the road surface, wherein the wear elements are rotatably mounted in a supporting device, said supporting device including a base member and a holder body with said wear elements being mounted in a row on said holder body, said base member having means for mounting said supporting device to a driving means for working said road surfaces while permitting substantially only linear movement of said support device, the wear elements rotatable relative to the road surfaces.

6. A device according to claim 5, wherein a frontal portion of the wear element intended to rest against the road surface is substantially conical and adapted to rest against the road surface along an envelope surface of the frontal portion, and the row of wear elements is adapted to form an angle of between 30° and 40° with the road surface.

7. A cutter means for working of road surfaces comprising a support device including a base member and a holder body, means for mounting said support device on a driving means for permitting substantially only linear movement of said support device, such as planing of roads having gravel or oil-gravel surfaces and ice-scraping of roads, wherein a plurality of tools in the form of wear elements are rotatably mounted in the holder body, said wear elements being mounted side by side and having tips for the working of the road surface, the wear elements being of generally longitudinal shape with the tips extending substantially beyond the holder body so as to be contactable with the road surfaces in the absence of said support device contacting said road surfaces.

8. A cutter according to claim 7, wherein the distance between adjacent tools is between 30 mm and 50 mm.

9. A cutter according to claim 7, wherein the longitudinal axes of the tools, when the base member is mounted on a planing blade, form an angle ($\alpha$) with the road surface of approximately 50°.

10. A cutter according to claim 7, wherein the distance between adjacent tools is approximately 38 mm.

11. A cutter according to claim 1, wherein the longitudinal axis of one of the tools, when the base member is mounted on a planing blade forms an angle ($\alpha$) with the road surface of between 20° and 90°.

12. A cutter according to claim 11, wherein the distance between adjacent tools is between 30 mm and 50 mm.

13. A cutter according to claim 11, wherein the distance between adjacent tools is approximately 38 mm.

14. A cutter according to claim 7, wherein the longitudinal axis of one of the tools forms an angle ($\beta$) between 20° and 50° with an abutting surface on the base member intended to rest against a planing blade.

15. A cutter according to claim 14, wherein the distance between adjacent tools is between 30 mm and 50 mm.

16. A cutter according to claim 14, wherein the distance between adjacent tools is approximately 38 mm.

* * * * *